US005393943A

United States Patent [19]

Furukawa et al.

[11] Patent Number: 5,393,943

[45] Date of Patent: Feb. 28, 1995

[54] ACCELERATION SENSOR

[75] Inventors: Koichi Furukawa; Kazuo Yoshimura, both of Kanagawa, Japan

[73] Assignee: Takata Corporation, Tokyo, Japan

[21] Appl. No.: 226,385

[22] Filed: Apr. 12, 1994

Related U.S. Application Data

[63] Continuation-in-part of Ser. No. 98,928, Jul. 29, 1993, abandoned.

[30] Foreign Application Priority Data

Aug. 25, 1992 [JP] Japan ..... 4-225684

[51] Int. Cl.[6] ..... H01H 35/14

[52] U.S. Cl. ..... 200/61.45 M

[58] Field of Search ..... 200/61.45 R, 61.45 M, 200/61.53; 335/205

[56] References Cited

U.S. PATENT DOCUMENTS

| | | | |
|---|---|---|---|
| 4,184,057 | 1/1980 | Kumita et al. | 200/61.45 R |
| 4,827,091 | 5/1989 | Behr | 200/61.45 M |
| 4,922,065 | 5/1990 | Behr et al. | 200/61.45 M |
| 4,933,515 | 6/1990 | Behr et al. | 200/61.45 M |
| 5,053,588 | 10/1991 | Bolender | 200/61.45 R |
| 5,123,499 | 6/1992 | Breed et al. | 180/282 |
| 5,149,925 | 9/1992 | Behr et al. | 200/61.45 M |
| 5,164,556 | 11/1992 | Yoshimura et al. | 200/61.45 M |
| 5,322,981 | 6/1994 | Grossi, III et al. | 200/61.45 M |

*Primary Examiner*—J. R. Scott

*Attorney, Agent, or Firm*—Kanesaka & Takeuchi

[57] ABSTRACT

An acceleration sensor is formed of a housing, an inertia member located inside the housing so as to be freely movable in a longitudinal direction of the housing, a conductor provided on at least an end surface of the inertia member in the longitudinal direction of the housing, a pair of electrodes disposed at one end side of the longitudinal direction of the housing, and electrically connected together by a conductive bridging inertia member. An attractor is disposed at the other end side of the longitudinal direction of the housing and magnetically attracts the inertia member. A stopper is disposed at an opposite side of the inertia member with respect to the electrodes, and abuts against the tip surface of the inertia member when the inertia member moves forwardly. The stopper is disposed at a position which is located off-center with respect to or deviated from the axial center line of the housing.

5 Claims, 3 Drawing Sheets

ACCELERATION SENSOR

CROSS-REFERENCE TO RELATED APPLICATION

This is a CIP application of patent application Ser. No. 098,928, filed on Jul. 29, 1993, now abandoned.

BACKGROUND OF THE INVENTION

1. Field of the Invention

This invention relates to an acceleration sensor, and particularly to an acceleration sensor suitable for detecting variation of speed which occurs due to collision and so on, of a vehicle.

2. Description of the Related Art

As this type of an acceleration sensor, U.S. Pat. No. 4,827,091 discloses an acceleration sensor comprising a housing of conductive material, a magnetized inertia member which is mounted in the housing so as to be freely movable in a longitudinal direction of the housing, a conductor provided on at least one end surface of the magnetized inertia member in the longitudinal direction of the housing, a pair of electrodes which are disposed at one side of the longitudinal direction of the housing and are electrically connected together through the conductor when contacted with the conductor of the magnetized inertia member, and an attractor of magnetic material which is disposed at the other end side of the longitudinal direction of the housing and magnetically attracting the magnetized inertia member.

In this acceleration sensor, the attractor attracts the inertia member, and thus the magnetized inertia member stands still at the other end side inside of the housing when no or little acceleration is applied to the acceleration sensor.

When some large acceleration is applied to the acceleration sensor, the magnetized inertia member is moved against the attraction force acting between the magnetized inertia member and the attractor. During movement of the magnetized inertia member, an induced current flows in the housing, and the magnetized inertia member receives a magnetic force which urges the magnetized inertia member in an opposite direction to the moving direction. Therefore, the magnetized inertia member is kept braked, and its moving speed is reduced.

When the acceleration is lower than a predetermined value (threshold value), the magnetized inertia member does not reach the end of the housing, and moves to a halfway position and stops there. Subsequently, the magnetized inertia member is pulled back to the other end side by the attraction force acting between the magnetized inertia member and the attractor.

On the other hand, when the acceleration is greater than the predetermined value (threshold value) for example, when a vehicle equipped with this acceleration sensor collides against an object, the magnetized inertia member reaches the one end side of the housing. The conductive layer of the tip surface of tile magnetized inertia member contacts the pair of electrodes to conduct electricity through the electrodes. A voltage is beforehand applied across the electrodes, so that current flows across the electrodes at the time when the electrodes are short-circuited. The collision of the vehicle is detected on the basis of this current.

A stopper is disposed at the opposite side to the magnetized inertia member with respect to the electrodes. When the magnetized inertia member with the acceleration greater than the above threshold value abuts against the electrodes and moves forwardly while pushing the electrodes, the magnetized inertia member finally abuts against the stopper. The magnetized inertia member keeps pushing against the stopper by the acceleration for a while, and for this period the conduction between the electrodes through the magnetized inertia member continues. As described above, the electrical conduction between the electrodes occurs for some long time, whereby the collision is electrically detected on the basis of this electrical conduction in a collision detection circuit.

However, in the conventional acceleration sensor, the magnetized inertia member is repelled by the stopper when the magnetized inertia member abuts against the stopper, and thus there occurs a case where a time for the conduction between the electrodes is shortened.

Further, in the conventional acceleration sensor, when the magnetized inertia member abuts against the stopper, the magnetized inertia member repetitively contacts with and separates from the stopper, and there frequently occurs chattering in the electrical conduction between the electrodes. That is, the magnetized inertia member abuts against the stopper and slightly repelled back. Thereafter, the magnetized inertia member is accelerated, and abuts against the stopper again and repelled back again. Subsequently, the magnetized inertial member is accelerated again and abuts against the stopper again. Such contact with (abutting against) and separation from the stopper are repeated. Such repetitive motion of the magnetized inertia member in the forward and backward directions as described above causes the electrodes to be frequently electrically interrupted, and thus the chattering is induced.

OBJECT AND SUMMARY OF THE INVENTION

An object of this invention is to provide an acceleration sensor in which the conduction between electrodes through an inertial member is continued for a long time.

Another object of this invention is to provide an acceleration sensor in which chattering is prevented.

The acceleration sensor according to this invention includes a housing, an inertia member which is mounted inside of the housing so as to be freely movable in the longitudinal direction of the housing, a conductor provided on at least one end surface of the inertia member in the longitudinal direction of the housing, a pair of electrodes which are disposed at one side of the longitudinal direction of the housing and electrically coupled together through the conductor when engaged with the conductor of the inertia member, an attractor which is disposed at the other end side of the longitudinal direction of the housing and magnetically attracts the inertia member, and a stopper which is disposed at an opposite side to the inertia member with respect to the electrodes and with which the tip surface of the inertia member engages when the inertia member moves forwardly, the stopper being disposed at a position which is deviated from the axial center line.

According to the acceleration sensor of this invention, when the greatly-accelerated inertia member moves forwardly and abuts against the stopper, the inertia member is inclined to such a direction that the direction of the axial center line of the inertia member intersects the axial center line of the housing. Through this motion, the inertia member is pushed against the inner peripheral surface of the housing. As a result, a relatively-large friction force occurs between the inertia member and the inner peripheral surface of the housing, and thus the inertia member is hardly moved. That is, even when the stopper repels back the inertia member, the inertia member is hardly moved backwardly, and the inertia member engages the stopper or stops in the neighborhood of the. stopper for a longer time, so that the conduction between the electrodes continues for a long time.

Further, the repetitive reciprocative motion of the inertia member in the forward and backward directions is prevented, and the chattering of the electrodes is prevented.

Figure 1:
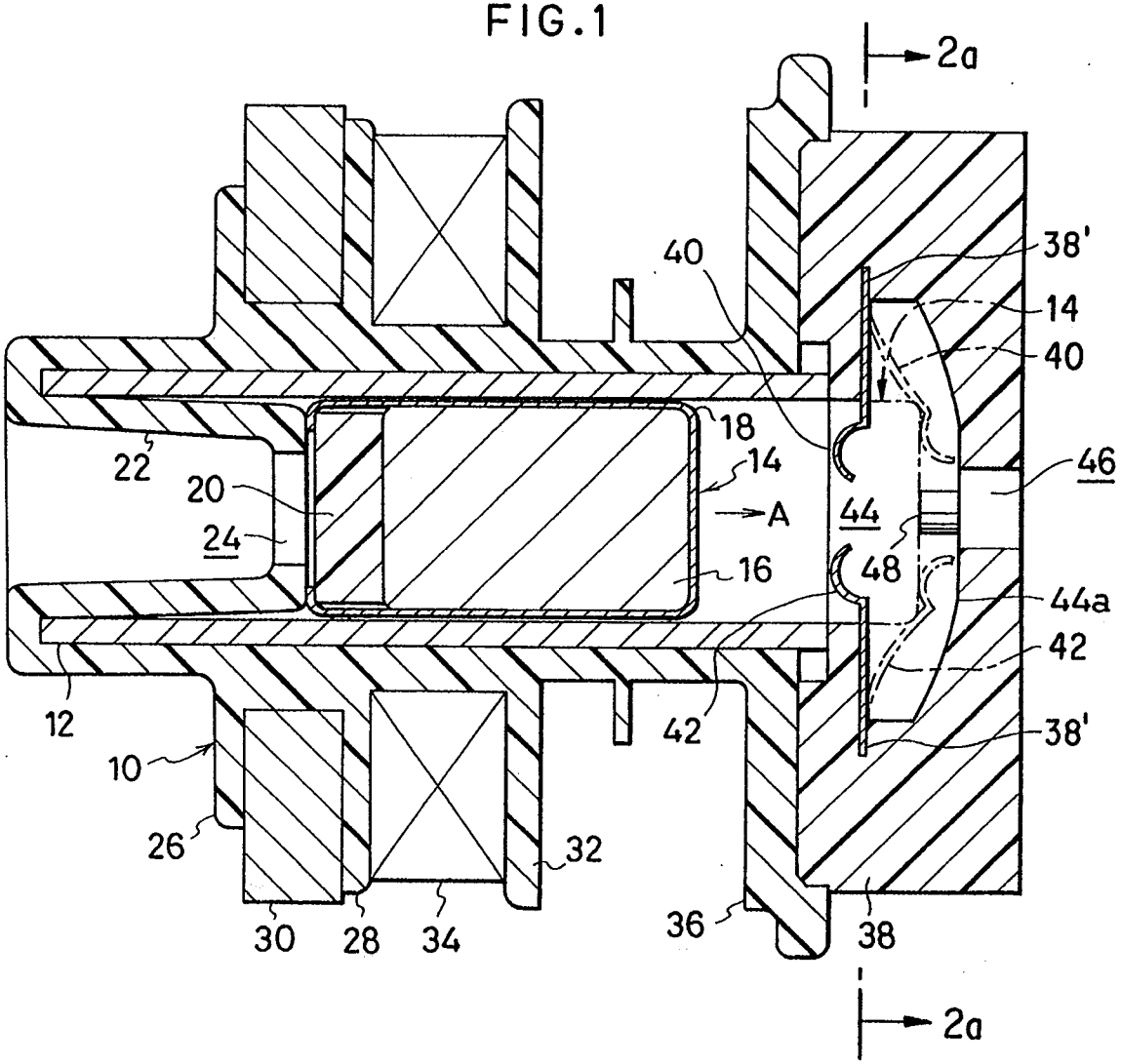
FIG. 1 is a cross-sectional view of an acceleration sensor according to an embodiment of this invention.

FIG. *2a* is a cross-sectional view of the acceleration sensor of FIG. 1, which is taken along a 2—2 in FIG. 1;

FIG. *2b* is an explanatory cross-sectional view for showing a condition that an inertia member abuts against a stopper; and FIGS. *3a* and *3b* are graphs showing experimental results.

DETAILED DESCRIPTION OF PREFERRED EMBODIMENTS

A preferred embodiment according to this invention will be hereunder described with reference to the accompanying drawings. FIG. 1 is a cross-sectional view of an acceleration sensor in a longitudinal direction of a housing, according to an embodiment of this invention, and FIG. *2a* is a cross-sectional view of the acceleration sensor which is taken along a line 2—2 of FIG. 1.

In FIG. 1, a housing 12 of copper alloy is held inside of a cylindrical bobbin 10 which is formed of non-magnetic material such as synthetic resin, and a magnetized inertia member (magnet assembly) 14 is mounted inside of the housing 12. The magnet assembly 14 is equipped with a solid-cylindrical permanent magnet (magnet) 16, a cylindrical case 18 containing the magnet 16 therein, which has a bottom and no lid and is formed of non-magnetic conductive material such as copper, and a synthetic resin packing 20 for holding the magnet 16 in the case 18.

The magnet assembly 14 is inserted into the housing 12 so as to be freely movable in the longitudinal direction of the housing 12. The outer diameter of the magnet assembly 14 is set to be slightly smaller than the inner diameter of the housing 12, and a slight gap is formed between the outer peripheral surface of the magnet assembly 14 and the inner peripheral surface of the housing 12.

The bobbin 10 has one end serving as an insertion portion 22 which extends into the housing 12, and an opening 24 is formed at the tip portion of the insertion portion 22. A pair of flanges 26 and 28 are projectingly provided to the bobbin 10 at a side portion of the insertion portion 22, and a ring-shaped attractor (return washer) 30 of magnetic material such as iron is provided so as to be sandwiched between the flanges 26 and 28.

The bobbin 10 is provided with another flange 32, and a coil 34 is wound between the flange 28 and the flange 32. Another flange 36 is provided at the other end side of the bobbin 10, and a contact holder 38 is secured to the flange 36.

The contact holder 38 is formed of synthetic resin, and a pair of electrodes 40 and 42 are embedded at rear ends into the contact holder 38 at portions 38'. The tip end side of each of the electrodes 40 and 42 is projected into a vacant room 44 of a central portion of the contact holder 38. The vacant room 44 extend at rear sides of the electrodes 40 and 42 so that the electrodes bend rearwardly. In addition, the tip end side of each of the electrodes 40 and 42 is bent in an arcuate form and disposed so that a part thereof is located on substantially the same plane as the tip surface of the housing 12.

The contact holder 38 is provided with an opening 46 through which the inside of the vacant room 44 is intercommunicated to the outside. A stopper 48 is projectingly provided on a surface 44*a* of the vacant room 44 confronting the tip surface of the magnet assembly 14. The stopper 48 is deviated from the axial center line of the housing 12.

Figure 2B:
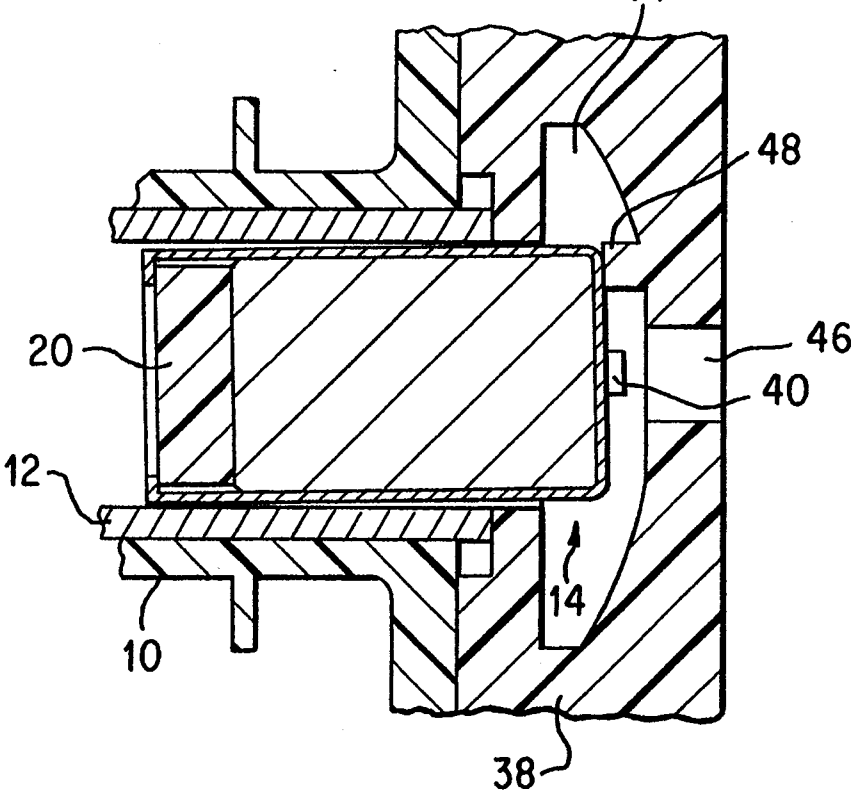
Figure 2A:
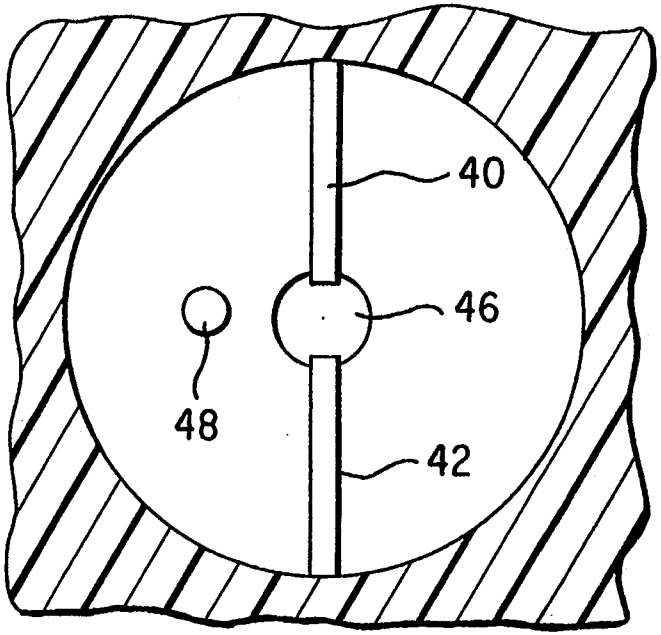

In this embodiment, as shown in FIG. 2, the electrodes 40 and 42 are disposed in a radial direction and extend toward the center of the vacant room 44. The stopper 48 is provided at the opposite side of the magnet assembly 14 with respect to the electrodes 40 and 42. The stopper 48 is disposed in the vacant room 44 so as to abut against the end portion of the tip surface of the magnet assembly 14.

In the acceleration sensor thus constructed, the magnet assembly 14 is attracted by the return washer 30 in a state where no external force is applied, so that the magnet assembly 14 is located at a backward limited position where the rear end of the magnet assembly 14 abuts against the tip surface of the insertion portion 22. Upon exertion of the external force in a direction as indicated by an arrow A, the magnet assembly 14 is moved in the direction as indicated by the arrow A against the attraction force acting between the magnet assembly 14 and the return washer 30. Through this motion, induced current flows in the housing 12 of copper alloy, and a magnetic field which is caused by the induced current induces a magnetic force in the direction opposite to the moving direction, so that a braking force is applied to the magnet assembly 14.

When an external force supplied to the acceleration sensor is small, the magnet assembly 14 is stopped at the time when it reaches a halfway position of the housing 12, and finally the magnet assembly 14 is returned to its backward limited position as shown in FIG. 1 by the attraction force between the magnet assembly 14 and the return washer 30.

When a great external force occurring at the collision time of the vehicle or the like is applied in the direction as indicated by an arrow A, the magnet assembly 14 moves forwardly to the tip of the housing 12, and engages with the electrodes 40 and 42. It further moves forwardly while pushing and bending the electrodes 40 and 42, and finally abuts against the stopper 48. This condition is shown in dotted lines in FIG. 1 and FIG. *2b*.

When the magnet assembly 14 engages with the electrodes 40 and 42, the electrodes 40 and 42 are short-circuited through the case 18 of the magnet assembly 14 which is formed of conductive material, so that current flows through the electrodes 40 and 42. Through this current flow, an acceleration variation which is greater than a predetermined threshold value is detected, and the vehicle collision is detected.

When the magnet assembly 14 moves forwardly and abuts against the stopper 48, since the stopper 48 is deviated from the center of the tip surface, the magnet assembly 14 is inclined to such a direction that the axial center line of the magnet assembly 14 intersects the axial center line of the housing 12. Through this inclination, the magnet assembly 14 is pushed against the inner peripheral surface of the housing 12, as shown in FIG. 2*b*. As a result, a relatively-large friction force occurs between the magnet assembly 14 and the inner peripheral surface of the housing 12, and the magnet assembly 14 is hardly moved. That is, the magnet assembly 14 is not easily backwardly moved even when the stopper 48 acts to repel the magnet assembly 14, and the magnet assembly 14 continuously engages the stopper 48 or stands substantially still in the neighborhood of the stopper 48 for a long time, and thus the conduction between the electrodes 40 and 42 continues for a long time.

The repetitive vibratory motion of the magnet assembly 14 is prevented, and thus the chattering of the electrodes 40 and 42 is prevented.

The coil 34 is used to check the operation of the acceleration sensor as described above. That is, upon supply of current to the coil 34, a magnetic field urging the magnet assembly 14 in the direction as indicated by the arrow A is generated by the coil 34, and the magnet assembly 14 moves forwardly to the tip of the housing 12 to short-circuit the electrodes 40 and 42. By forcedly moving the magnet assembly 14 on the basis of the current supply to the coil 34, it can be checked whether the magnet assembly 14 can be moved, and whether the electrodes 40 and can be short-circuited.

Next, experimental results will be described.

(Example of this Embodiment)

The following experimental conditions were set for the acceleration sensor as shown in FIGS. 1 and 2.

Inner diameter of housing 12 7.0 mm
Outer diameter of housing 12 8.7 mm
Length of housing 12 19.2 mm
Diameter of magnet assembly 14 6.7 mm
Length of magnet assembly 14 12.0 mm
Projection length of stopper 48 3.0 mm
Diameter of cylindrical stopper 48 1.6 mm
Stroke until magnet assembly 14 abuts against electrodes 40 and 42 5.5 mm
Stroke until magnet assembly 14 abuts against stopper 48 after it abuts against electrodes 40 and 42 4.0 mm In the acceleration sensor, a conduction time between the electrodes 40 and 42 when the magnet assembly 14 engaged the stopper 48 by applying maximum acceleration (peak G) as shown by Nos. 1 and 2 in a table 1 was measured. The result is also shown in the table 1.

Figure 3A:
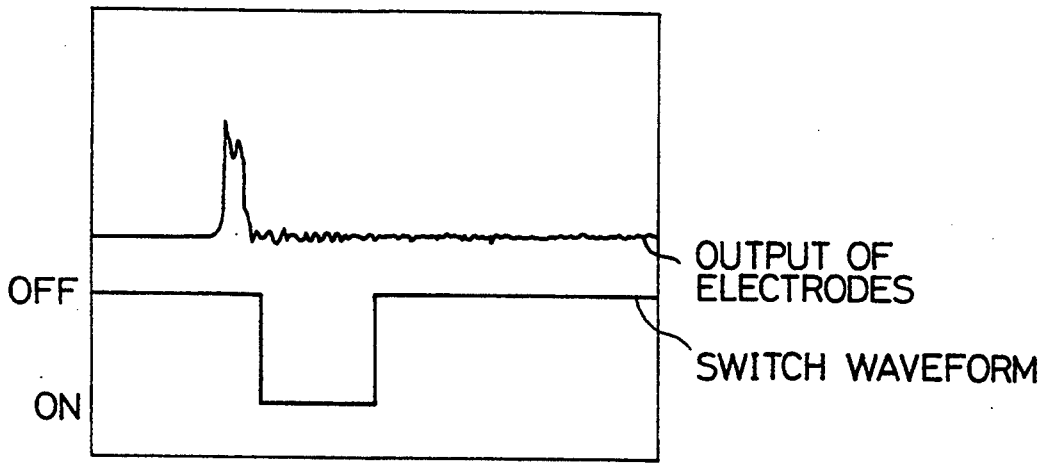
Figure 3B:
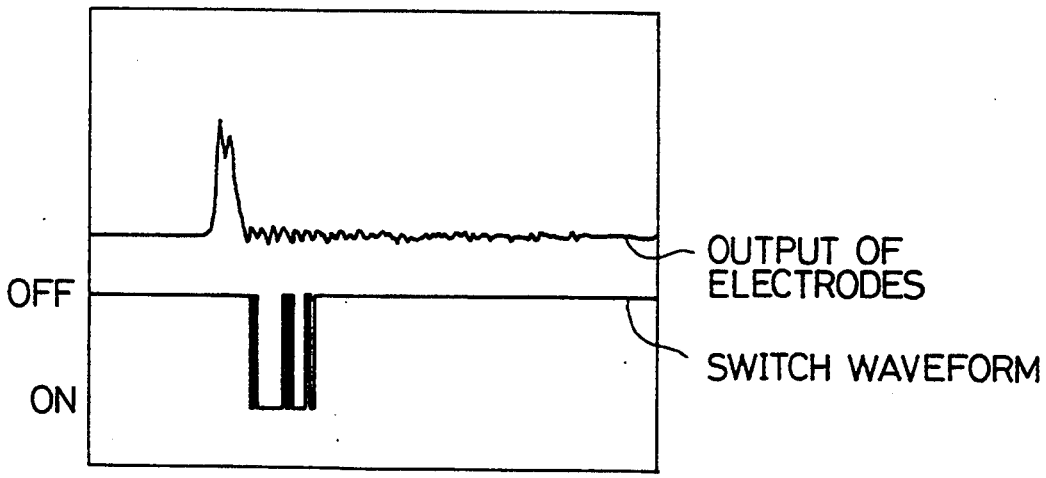

FIGS. 3*a* and 3*b* are voltage waveform diagrams of an electrode output and an output waveform diagram of the collision detection circuit for maximum acceleration of 200 G in this invention and the comparative example as described below.

(Comparative Example)

The same measurement was made except that the stopper 48 was disposed along the axial center line of the housing 12 and the position of the opening 46 was deviated. The result is shown in the table 1 and in FIGS. 3*a* and 3*b*.

From the table 1, according to the example of this invention, the conduction time between the electrodes 40 and 42 is remarkably prolonged in comparison with the comparative example.

From FIG. 3*b*, an intensive chattering occurred in the comparative example whereas no chattering occurred in this invention (FIG. 3*a*).

TABLE 1

| | NO. | ACCEL. (G) | CONDUCTION TIME (ms) |
|---|---|---|---|
| THIS INVENTION | 1 | 200 | 10.00 |
| | 2 | 300 | 9.23 |
| COMP. EXAMP. | 3 | 200 | 5.26 |
| | 4 | 300 | 3.94 |

In the above embodiment, the inertia member 14 is magnetized, however, a non-magnetized inertia member may be used. In this case, a magnetized return washer is used as the return washer 30. In this case, the housing 12 may be formed of non-conductive material.

As described above, according to the acceleration sensor of this invention, the position of the stopper against which the inertia member abuts is deviated from the axial center line of the housing, so that during a collision the inertia member engages the stopper for a long time or stands substantially still in the neighborhood of the stopper. Therefore, the conduction state between the electrodes is continued for a long time, and the chattering is prevented during the conduction state. As a result, the detection precision of the vehicle collision is remarkably improved.

What is claimed is:

1. An acceleration sensor, comprising:

a housing;

an inertia member mounted inside of said housing so as to be freely movable in a longitudinal direction of said housing;

a conductor provided on at least an end surface of said inertia member in the longitudinal direction of said housing;

a pair of electrodes disposed at one end side of the longitudinal direction of said housing, and being electrically connected together through said conductor when said conductor of said inertia member engages said electrodes;

an attractor disposed at the other end side of the longitudinal direction of said housing and magnetically attracting said inertia member; and a stopper disposed at a side opposite to said inertia member with respect to said electrodes to abut against a tip surface of said inertia member when said inertia member moves forwardly, said stopper being disposed at a position deviated from an axial center line of said housing so that the inertia member inclines relative to the housing and frictionally engages the housing when the inertia member hits the stopper.

2. The acceleration sensor as claimed in claim 1, further comprising a contact holder provided at the one end of the longitudinal direction of said housing, wherein said contact holder is provided with a cylindrical vacant room disposed coaxially with said housing and intercommunicated to the inside of said housing, and said electrodes project from an inner surface of said vacant room of said contact holder.

3. The acceleration sensor as claimed in claim 2, wherein said stopper is projectingly provided at a position which is on a surface confronting the tip surface of said magnetized inertia member of the inner surface of said vacant room of said contact holder.

4. The acceleration sensor as claimed in claim 3, wherein said electrodes face each other in a radial direction of said vacant room, and end portions of the electrodes extend toward a lower surface of said vacant room.

5. The acceleration sensor as claimed in claim 1, wherein a gap is provided between an outer peripheral surface of said inertia member and an inner peripheral surface of said housing so that when said magnetized inertia member moves forwardly and abuts against said stopper, said inertia member is inclined in such a direction that the axial center line thereof intersects with the axial center line of said housing to push the inertia member against the inner peripheral surface of said housing, thereby increasing frictional force between said inertia member and the inner peripheral surface of said housing.

* * * * *